United States Patent [19]

Ono

[11] Patent Number: 4,554,895

[45] Date of Patent: Nov. 26, 1985

[54] HYDRAULIC LIFTER FOR INTERNAL COMBUSTION ENGINES

[75] Inventor: Takuro Ono, Chiryu, Japan

[73] Assignee: Aisin Seiki Kabushiki Kaisha, Kariya, Japan

[21] Appl. No.: 578,095

[22] Filed: Feb. 8, 1984

[30] Foreign Application Priority Data

Feb. 17, 1983 [JP] Japan ..... 58-25951

[51] Int. Cl.[4] ..... F01L 1/24

[52] U.S. Cl. ..... 123/90.55; 123/90.27; 123/90.46

[58] Field of Search ..... 123/90.55, 90.27; 123/90.46, 90.57

[56] References Cited

U.S. PATENT DOCUMENTS

| | | | |
|---|---|---|---|
| 3,314,404 | 4/1967 | Thompson | 123/90.27 |
| 3,401,677 | 9/1968 | Ronzi | 123/90.27 |
| 3,897,761 | 8/1975 | Fleischer et al. | 123/90.55 |
| 4,475,497 | 10/1984 | Honda et al. | 123/90.55 |

FOREIGN PATENT DOCUMENTS

| | | | |
|---|---|---|---|
| 79603 | 5/1983 | European Pat. Off. | 123/90.27 |
| 121316 | 9/1979 | Japan | 123/90.55 |

*Primary Examiner*—Ira S. Lazarus

*Attorney, Agent, or Firm*—Oblon, Fisher, Spivak, McClelland & Maier

[57] ABSTRACT

A hydraulic lifter incorporated into a rocker arm of a valve train in an internal combustion engine includes a cylinder formed in the rocker arm, a plunger arranged slidably in the cylinder, a valve seat member dividing an inside portion of the cylinder into a pressure chamber and a reservoir chamber for working fluid, a check valve allowing the working fluid to flow from the reservoir chamber into the pressure chamber, a spring positioned within the pressure chamber to bias the plunger, and a passage for supplying the working fluid to the reservoir chamber.

1 Claim, 2 Drawing Figures

HYDRAULIC LIFTER FOR INTERNAL COMBUSTION ENGINES

BACKGROUND OF THE INVENTION

1. Field of the Invention

This invention relates to hydraulic lifters to be used in a valve train of internal combustion engines and more particularly to improved hydraulic lifters incorporated into the rocker arm in the valve train of overhead cam (OHC) type.

2. Discussion of the Background

The conventional structure of a hydraulic lifter incorporated into the rocker arm of the valve train of the internal combustion engine is disclosed, for example, in the Japanese Patent Laid-open Publication No. 16112/1978. In this conventional hydraulic lifter, a lifter body is inserted into a hole formed in the rocker arm and a plunger is arranged slidably in the cylinder formed in said lifter body. A reservoir chamber for storage of working fluid is formed in the plunger and the plunger is provided with a partition wall separating the reservoir chamber from a pressure chamber. Since the reservoir chamber is provided in the plunger and the partition wall having a check valve seat is integrally formed into the plunger, the plunger cannot avoid being large in order to secure a reservoir chamber which takes a relatively large volume. This increases the overall size of the hydraulic lifter as well as the inertial mass of the valve train, resulting in a drawback in that the operating range of the engine rotation decreases. Another problem is that the manufacturing costs increases because of the complex shape of the plunger.

SUMMARY OF THE INVENTION

An object of this invention is to provide a hydraulic lifter which is small in size and simple in configuration.

Another object of this invention is to provide a hydraulic lifter that permits oil to be retained sufficiently in the oil reservoir even when the engine is not running and that prevents air from being introduced into the pressure chamber.

According to the present invention, a cylinder that has an opening at the lower end thereof is formed in the rocker arm of the valve train of an engine, a plunger is slidably arranged in said cylinder, and the open end of the cylinder is blocked with said plunger. A valve seat member is fixed to the inner periphery surface of the cylinder, thereby dividing the cylinder into the pressure chamber on the plunger side and the reservoir chamber on the opposite side. That is to say, a part of the rocker arm constitutes the lifter body directly. The employment of this configuration eliminates the need of inserting a separate lifter body into the cylinder. Furthermore, it is not possible to only simplify the plunger profile and the structure of the hydraulic lifter by forming the reservoir chamber separately from the plunger, but also the specified volume of the reservoir chamber can be secured. Since the plunger is of a simple cylindrical shape, the production costs can be held low.

According to the present invention, furthermore, the passage for feeding working fluid such as oil has an opening at the upper end of the reservoir chamber. This ensures sufficient oil to the reservoir chamber even when the engine is not running. Therefore, introduction of air into the pressure chamber is inhibited when the engine is started with the hydraulic lifter in a compressed state.

The foregoing and other objects, features and advantages of the present invention will be understood more clearly and fully from the following detailed description of preferred embodiment with reference to the attached drawings.

DESCRIPTION OF THE PREFERRED EMBODIMENT

Figure 1:
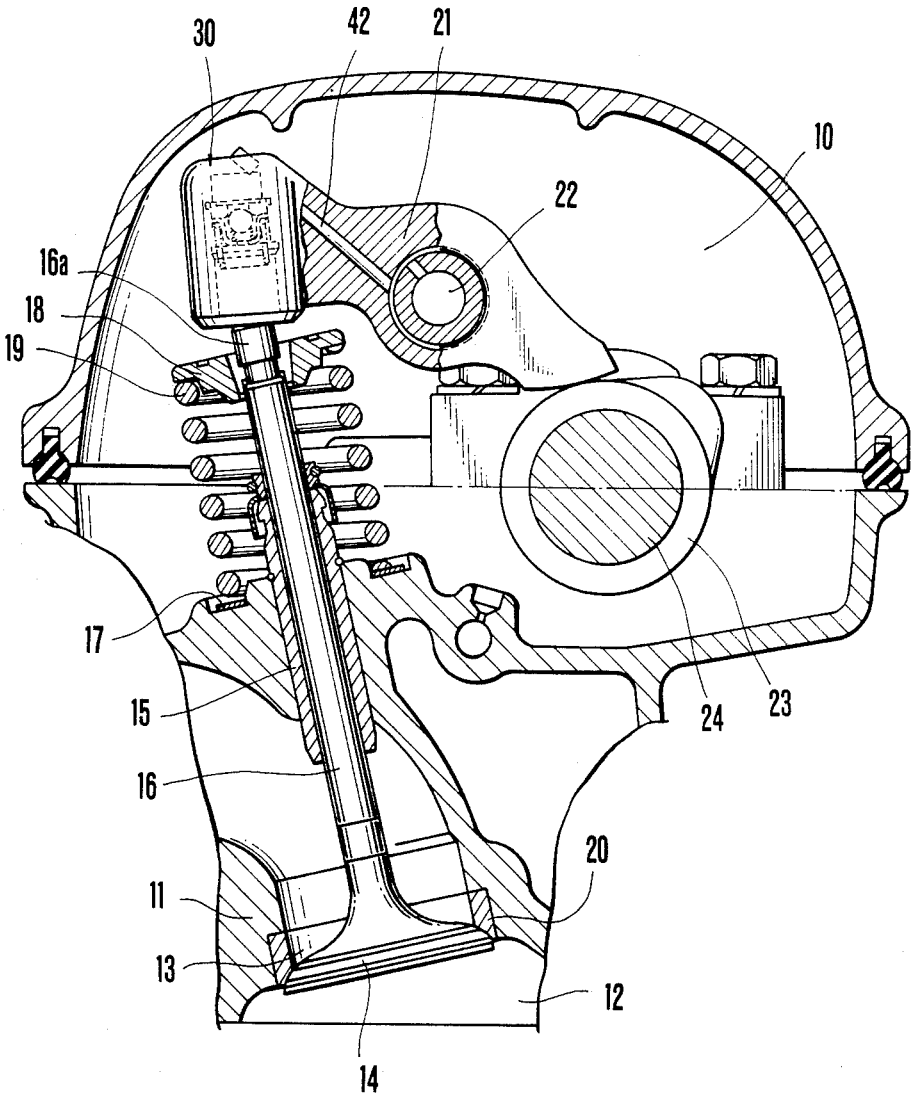
FIG. 1 is a sectional view that shows a valve train of an internal combustion engine equipped with a hydraulic lifter according to the present invention.

Referring now to FIG. 1, an engine combustion chamber 12 is formed by a cylinder head 11 that forms the upper end of an engine cylinder in the valve train (overhead cam system) of an internal combustion engine and communication between said combustion chamber 12 and cylinder head port 13 is controlled by the opening and closing of an engine valve 14. A valve stem 16 is slidably inserted and installed in a valve guide 15 which is embedded in the cylinder head 11. A valve spring 19 is interposed between a spring seat fixed to the upper end surface of the cylinder head 11 and a spring retainer 18 fixed to the upper end of the valve stem 16. The valve 14 is biased upwardly by said valve spring 19 as shown in the figure so that it sits on a valve seat 20.

A rocker arm 21 is supported with a rocker arm shaft 22 as a fulcrum in a manner that permits oscillation freely, and it is subject to the load from a cam 23 on one end while it is connected operatively to the valve stem on the other end through the hydraulic lifter of the present invention. The cam 23 is so designed that it rotates integrally with a cam shaft 24 and rotates interlocked with the crank shaft. The valve stem 16 is driven vertically by the rotating motion of the cam shaft 24 through the rocker arm 21 and hydraulic lifter, whereby the valve 14 repeats opening and closing operations.

Figure 2:
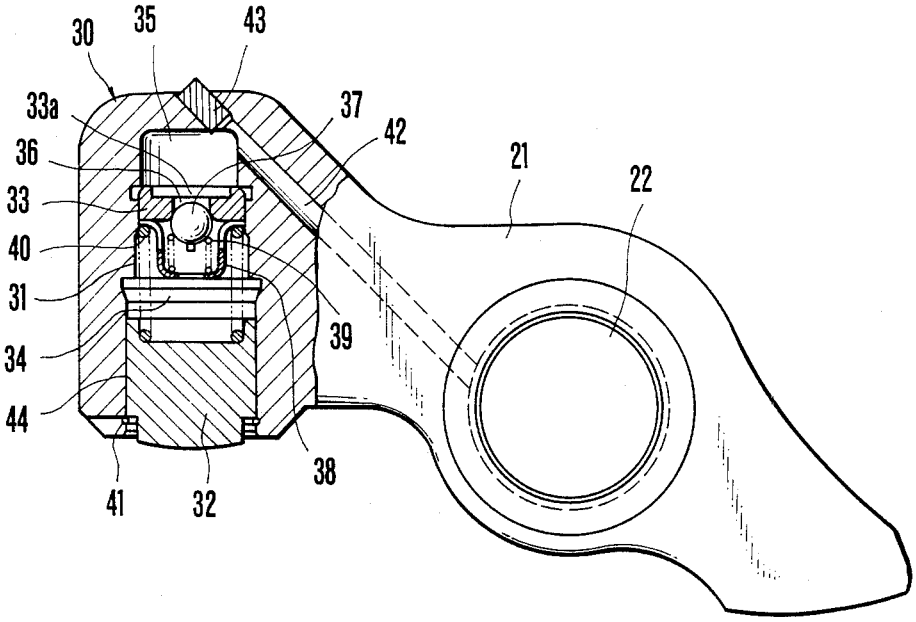
FIG. 2 is a sectional view showing an embodiment of the hydraulic lifter according to the present invention.

Referring to FIG. 2, a cylinder 31 is formed inside the rocker arm 21 at the side to be contacted with the valve stem 16, and the lower end of said cylinder is open. A plunger 32 is slidably inserted in said cylinder 31 and the open end of the cylinder 31 is blocked with said plunger 32. The lower end surface of the plunger 32 is in contact with the upper end **16*a* of the valve stem 16, and the contact surface of the plunger 32 is designed in a spherical shape so that the valve stem 16 can be directly driven. Since the plunger 32** is of a simple cylindrical shape, an ordinary solid pin suffices for the requirement. For example, the roller of the roller bearing can be used.

A valve seat member 33 is press-fitted and fixed to the inside wall surface of the cylinder 31, being located at the upper end portion of the plunger 32. By this member 33, the cylinder is separated into two chambers, that is, a pressure chamber 34 of the plunger side and reservoir chamber 35 on the upper side. Ordinarily, the reservoir chamber 35 is machined from the direction in which the plunger 32 is to be inserted. The valve seat member 33 is made of highly wear-proof materials and is provided at the center thereof with an axial hole 36 which interconnects the pressure chamber 34 and the reservoir chamber 35. At the same time, a step **33*a* is formed for increase of the volume of the reservoir chamber 35 and for distinction at the time of assembly. A ball check valve 37 is arranged on the side of the pressure chamber 34 on the valve seat member 33 and said valve 37 is pushed by one end of a small-load spring 39, while the other end of which is held by a retainer member 38, in the upward direction shown in the figure, that is, in the direction of contacting the seat surface of the valve seat member 33. Thus, the ball check valve 37 allows the working fluid to flow from the reservoir chamber 35 into the pressure chamber 34. Within the pressure chamber 34, furthermore, a plunger return spring 40 is positioned, which is held by a retainer 38 at one end, and the plunger 32 is biased by the other end of said spring 40 in the downward direction shown in the figure, that is, in the direction of contacting the valve stem 16. The downward movement of the plunger 32 is limitted by a snap ring 41**.

In the rocker arm 21, a working fluid supply passage 42 is formed and engine oil is forcefully supplied to the reservoir chamber 35 from a working fluid supply source such as oil pump through said passage 42. The working fluid supply passage is open at the upper end of the reservoir chamber 35. Thus such is so constructed that the working fluid in the reservoir chamber 35 does not flow out when the engine stops so as to secure a sufficient amount of working fluid in the reservoir chamber 35. The working fluid supply passage 42 is machined from the upper portion of the rocker arm 21 to the rocker shaft 22, and the upper end of the rocker arm 21 is blocked with a blind stopper 43.

In the device of the above-mentioned configuration, oil pumped by the oil pump is supplied to the reservoir chamber 35 and the cam shaft 24 starts rotating with starting of the engine, whereby the plunger 32 is pushed downward as shown in the figure. As a result, the pressure of the oil in the pressure chamber 34 increases and the check valve 37 closes the axial hole 36. Here, the oil leaks out from the pressure chamber 34 through the leak clearance 44 between the inside wall surface of the cylinder 31 and plunger 32. Consequently, the plunger 32 descends by a distance ($\alpha$) with respect to the rocker arm 21. With further rotation of the cam shaft 24,the plunger 32 is pushed down by the downward force of the plunger return spring 40 by the distance ($\alpha$) with respect to the rocker arm. As a result, the pressure of the oil in the pressure chamber 34 lowers and the check valve 37 opens the axial hole 36. Here, the oil in the reservoir chamber 35 flows into the pressure chamber 34. Therefore, the hydraulic lifter restores its original length as a whole. In this manner the hydraulic lifter 30 normally repeats elongation and contraction by the aforementioned distance ($\alpha$) during the engine runs.

On the other hand, if a clearance is produced in the valve train due to thermal expansion of the crank case, cylinder, etc., the plunger 20 is pushed downward relative to the rocker arm 21 by the force of the plunger return spring 40. If the valve train elongates by a distance ($\beta$) in the reverse state to that explained above, the hydraulic lifter 30 is pushed back downwardly by the dimension less the $\beta$ distance, that is, by $l=\alpha-\beta$ distance when the plunger 32 which has contracted by $\alpha$ distance is pushed back downwardly by the spring 40, to make the valve train zero lash for smooth movement.

It should be understood that the perferred embodiment of the present invention has been described herein in considerable detail and that certain modifications, changes, and adaptations may be made therein by those skilled in the art and that it is hereby intended to cover all modification, changes and adaptations thereof falling within the scope of the appended claims.

What is claimed as new and desired to be secured by letters patent of the United States is:

1. A hydraulic lifter for internal combustion engines, comprising:

a valve train including a rotation cam, a rocker arm and a valve stem, said rocker arm receiving the load from said rotating cam by one end and operating said valve stem by the other end;

a cylinder formed as an open-lower-end hole in said one end of said rocker arm;

a plunger slidably inserted into the lower portion of said cylinder and contacting an upper end of said valve stem;

valve means arranged in said cylinder and dividing the internal space of said cylinder into a pressure chamber of the lower portion and an oil reservoir chamber of the upper portion, said valve means including means for allowing said oil to flow from said reservoir chamber into said pressure chamber;

a spring positioned within said pressure chamber and biasing said plunger to said valve stem; and oil inlet means opened at the upper end portion of said reservoir chamber.

* * * * *